US006568341B1

(12) United States Patent
Sosa

(10) Patent No.: US 6,568,341 B1
(45) Date of Patent: May 27, 2003

(54) VESSEL FOR DATA COLLECTION IN AQUATIC ENVIRONMENTS

(75) Inventor: Anier Sosa, West Palm Beach, FL (US)

(73) Assignee: South Florida Water Management District, West Palm Beach, FL (US)

( * ) Notice: Subject to any disclaimer, the term of this patent is extended or adjusted under 35 U.S.C. 154(b) by 0 days.

(21) Appl. No.: 09/982,913

(22) Filed: Oct. 18, 2001

(51) Int. Cl.[7] ..... B63B 1/00
(52) U.S. Cl. ..... 114/61.1; 114/151
(58) Field of Search ..... 114/61.2, 61.1, 114/61.22, 61.27, 151

(56) References Cited

U.S. PATENT DOCUMENTS

| | | | | |
|---|---|---|---|---|
| 2,726,471 A | | 12/1955 | Uus | |
| 3,078,617 A | | 2/1963 | Dempsey | |
| 3,246,419 A | | 4/1966 | Pawelka | |
| 3,342,032 A | | 9/1967 | Cox | |
| 3,555,721 A | | 1/1971 | Furuoka | |
| 3,673,976 A | * | 7/1972 | Reynolds | 114/343 |
| 3,793,761 A | | 2/1974 | Bonham | |
| 3,933,113 A | | 1/1976 | Dornak | |
| 4,020,777 A | * | 5/1977 | Brown et al. | 114/258 |
| 4,045,907 A | | 9/1977 | Mumford | |
| 4,214,544 A | | 7/1980 | Dashew | |
| 4,292,758 A | | 10/1981 | Kuna | |
| 4,349,985 A | | 9/1982 | Kodaka | |
| 4,455,960 A | | 6/1984 | Aker | |
| 4,807,552 A | | 2/1989 | Fowler | |
| 4,826,465 A | | 5/1989 | Fleischmann | |
| 4,919,637 A | | 4/1990 | Fleischmann | |
| 4,955,843 A | | 9/1990 | Bolanos | |
| 5,117,774 A | * | 6/1992 | English et al. | 114/61.1 |
| 5,154,016 A | | 10/1992 | Fedora | |
| 5,165,193 A | | 11/1992 | Dankwardt | |
| 5,203,732 A | | 4/1993 | Cusson | |
| 5,282,763 A | | 2/1994 | Dixon | |
| 5,309,664 A | | 5/1994 | Wright | |
| 5,361,530 A | | 11/1994 | Kashani | |
| 5,363,587 A | | 11/1994 | Nordling | |
| 5,713,293 A | * | 2/1998 | Shiffler et al. | 114/1 |
| 5,806,232 A | | 9/1998 | James | |
| 5,947,788 A | | 9/1999 | Derrah | |
| 6,041,537 A | | 3/2000 | Sullivan | |

* cited by examiner

*Primary Examiner*—Jesus D. Sotelo
(74) *Attorney, Agent, or Firm*—Olga Gonzalez, P.A.

(57) ABSTRACT

The present invention provides a remotely controllable, miniature vessel for use in the collection of data in aquatic environments. The miniature, boat of the present invention has two opposite parallel pontoons held in such position by at least one transverse member. The boat has an electro-mechanical module including a power source, propulsion means, remote control receiver and a plurality of servos operatively connected to allow the speed and direction of the vessel to be controlled remotely. A removable platform between the front sections of the pontoons permits the mounting of water collection data apparatus, such as light weight Doppler or water sampling devices. Real time communication of data collected may be made by a modem on board the vessel.

15 Claims, 9 Drawing Sheets

72
24
184
214
202
212
160
162
152
156
164
158
154
208
144
148
142
120
102
140
101
122
138
206
h
ℓ

RUDDER SERVO
134
PUSH / PULL SERVO SET-UP
RUDDER SERVO
REVERSE SERVO
REVERSE SWITCH
128
FROM FIG. 8-1
DIGITAL SPEED CONTROL
TO MOTOR
129
FIRST BOW THRUSTER
TO BOW THRUSTER
130
SECOND BOW THRUSTER
TO BOW THRUSTER
132
STROBE SERVO
TO STROBE LIGHT
126

VESSEL FOR DATA COLLECTION IN AQUATIC ENVIRONMENTS

FIELD OF THE INVENTION

This invention relates to a vessel for use in the collection of data in aquatic environments. More particularly, the present invention relates to a remotely controllable, miniature, boat capable of holding and transporting water data collection apparatus on bodies of water, including remote or constricted areas, such that appropriate data readings and or samples may be obtained.

BACKGROUND OF THE INVENTION

The collection of water data is of vital importance to water management, including flood and draught control and environmental safety and preservation. Data collection includes obtaining measurements of stream flow and velocity, water quality, bathymetry (the science of measuring the depths of oceans, seas and other water bodies), and surveying locations. For instance, in the management of water, it is often necessary to move water from reservoirs, such as lakes or dams, through canals to other locations. In accomplishing such movement, it is essential to know when gate or pump systems must be activated. This in turn requires comprehensive and accurate data relating to the relevant water bodies. In the past, it has been very difficult, dangerous and expensive to collect such data.

Oftentimes overgrown banks, shifting sediments and the population of areas make it difficult to determine the amount of water that should be moved through canal systems. Previous data collection methods have involved the deployment of technician crews to sites where date collection is desired. Such methods have included the use of measuring rods or flow meters by technicians while physically standing in streams. The technician must manually take the required measurements at various depths and vocally convey the measurements to another technician standing on the shore who records the measurements. As can be appreciated, such measurements are limited as the technician can only go a certain distance into the water body and still take the necessary measurement. The communication of the data to the second technician is often not heard correctly and must be repeated. There are also significant dangers to the technician in the water who may be attacked by various life forms residing within the water body. The technician's safety may also be imperilled by strong currents, other vessels or water contaminated by pollutants.

In other methods, water data has been collected through the use of cranes, having data collection apparatus mounted thereon. The cranes are further mounted on structures spanning water bodies, such as bridges. It is not possible to comprehensively collect data with such methods, given that in some locations bridges are not present and measurements for those locations go unrecorded. Additionally, the set up for mounting the cranes on the bridges is costly and time consuming. Moving vehicles on such bridges present risk of harm to the data collecting devices and the technicians operating them.

Yet another water data collection method previously used involves full size boats. In such method, technicians must load data collection equipment onto full size boats and steer or operate such boats to the locations were data collection is desired. It may be necessary to hold the boat in place in a body of water by a tag line on each bank of the canal so that accurate measurements or readings may be taken. The use of tag lines can be hazardous, particularly when other boats are travelling on the same body of water and such boats may run into or become entangled in the tag lines. Full size boats are expensive to acquire and may be dangerous to operate in adverse weather conditions, thereby imperiling the safety of the technician operators who are onboard. Full size boats require large hangars for storage or docks for mooring. The loading, set-up and launching of full size boats to collect data can be very time consuming. Additionally, it may be difficult or impossible to maneuver a full size boat into a remote or very narrow location. Given that many locations are inaccessible to such full size boats, the collection of water data has not heretofore been done in such areas.

The present invention provides an inexpensive and safe way to collect water data. A remotely controllable, miniature boat is provided having the capability to receive, hold and transport sensitive water data collection apparatus to previously inaccessible aquatic environments. Although radio controlled boats have been used in the past, such uses have been unrelated and different from those of the present invention, such as for amusement as toys or to accomplish fishing. For instance, U.S. Pat. Nos. 6,041,537, 5,806,232, 5,363,587, 5,361,530, 5,309,664, 5,165,193 and 5,154,016 are each concerned with some type of fishing operation such as remotely delivering bait or fishing poles to a fishing location. Such patents do not involve the special task of transporting sensitive measurement devices in manner which optimizes the accuracy of readings taken and permits immediate real time communication of the recorded data as can be done with the vessel of the present invention. Accordingly, the components and structure of the boats of such patents are entirely inapposite to the present invention.

SUMMARY OF THE INVENTION

It is an object of the present invention to provide a vessel for use in the collection of data in aquatic environments. Aquatic environments is intended to include bodies of water, such as lakes, ponds, streams, rivers, canals, swamps and marshes. It is also an object of the present invention to provide a compact and lightweight vessel for water data collection apparatus such that the vessel may be easily transported and stored on land in relatively small spaces. The vessel of the present invention is a light weight, miniature boat constructed of aluminum. Because of its miniature size, the vessel may be transported on the bed of a pick-up truck and it may be stored when not in use in a small room as opposed to large hangars or sheds as would be required for full size boats. The compact size of the present vessel makes it able to be used in very narrow or remote locations on bodies of water. The miniature size also minimizes resistance to wind while the vessel is in use thereby assisting in propulsion.

It is also an object of the present invention to provide a vessel that does not require onboard operators to function. The boat of the present invention can be controlled remotely by use of a radio transmitter and radio receiver on the vessel that communicates the radio signals to the respective vessel servos for directing parameters such as speed of propulsion and direction of movement. The data collection apparatus transported thereon may also be controlled remotely from shore. Accordingly, the vessel of the present invention provides a safe way for data to be collected with reduced equipment set-up and launching time as compared to that of a full size boat.

The vessel of the present invention has two opposite and parallel aluminum pontoons held permanently in such position by at least one transverse member horizontally spanning the pontoons and welded thereto. Because the vessel of the present invention is not a mono-hull or single hull design, its construction is much simpler and inexpensive as it is not necessary to make or fashion wells or pockets for containment of operating devices or data collection apparatus. The twin pontoons also provides enhanced floatability to the vessel of the present invention. Each pontoon front section terminates in a five sided tip which assists the vessel's ability to travel on water by reducing wind resistance and by cutting through highly viscous, polluted or vegetation inhabited waters.

The twin pontoons permits the mounting of an electro-mechanical module between the pontoon rear sections. The electro mechanical module houses the components which permit the vessel of the present invention to travel on water such as servos regulating the propulsion system's drive motor and rudder/propeller. Additionally, the electro-mechanical module provides buoyancy for the vessel of the present invention. In case the pontoons are damaged or rendered inoperable, the electro mechanical module is independently able to float on water. Because of the vessel's light weight and ability to float on water, the water line is only about twenty to thirty percent (20–30%) of the height of the vessel of the present invention taken from the bottom of the pontoons. This permits the vessel to travel easily on water bodies having vegetation, muck, mud or pollutants.

The twin pontoons also permits the mounting of data collection apparatus between the pontoon front sections. As such, the data collection apparatus can be positioned upward and forward looking and has unobstructed access to the area to be researched or studied. Because the data collection apparatus is mounted above the pontoons, contact between the apparatus and the water body is thereby avoided.

The vessel of the present invention is also particularly suited for permitting the collection of measurements which must be repeated along a given linear path. Each pontoon has a bow thruster which comprises a water pump, a motor for the water pump and a water discharge means. The bow thruster is contained within the front section of the pontoon. Water is drawn into the bow thruster through the pontoon bottom and expelled through an exhaust on the outer side of the pontoon below the water line. The bow thrusters permit the vessel of the present invention to rotate about its central axis thereby permitting movement and corresponding measurement of constricted spaces, as well as linear paths along which measurements must be repeated numerous times.

Other objects, features, and advantages of the invention will be apparent by reference to the written description and the drawings which follow.

DESCRIPTION OF THE DRAWINGS

In the course of the following detailed description of the present invention, reference will be made to the appended drawings in which.

DESCRIPTION OF THE INVENTION

Figure 1:
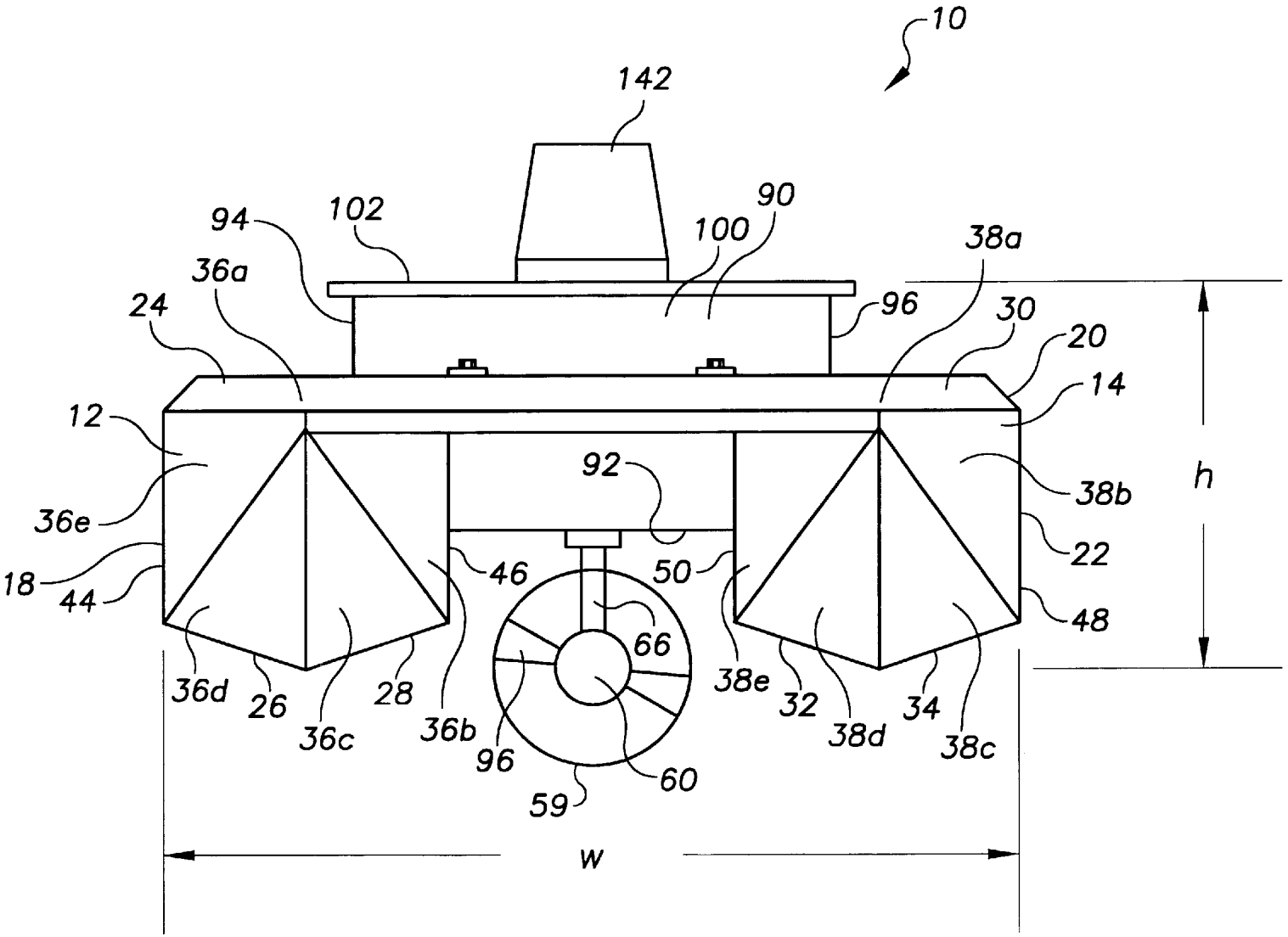
FIG. 1 is front view of the vessel of the present invention.
Figure 2:
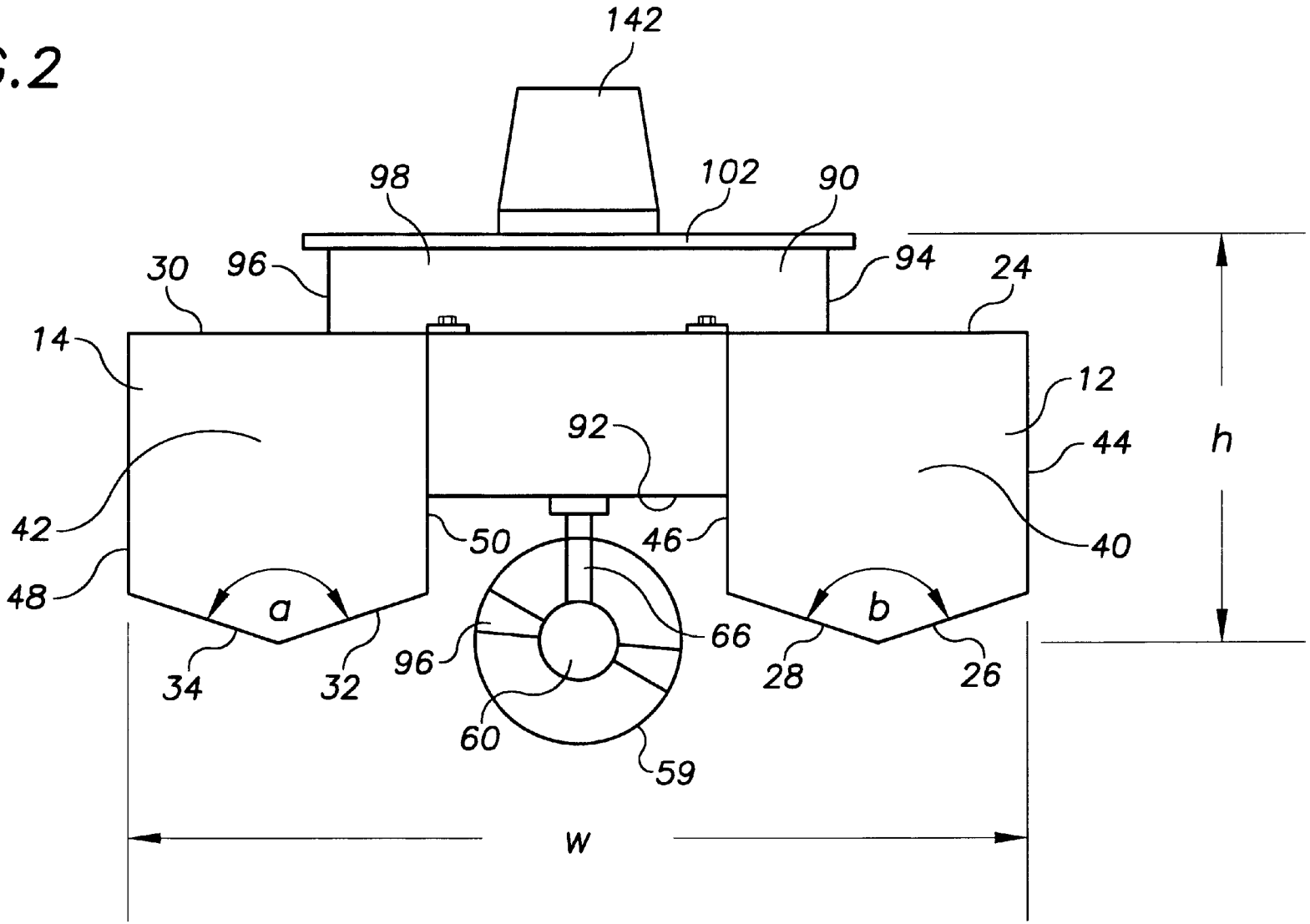
FIG. 2 is a back view of the vessel of the present invention.
Figure 3:
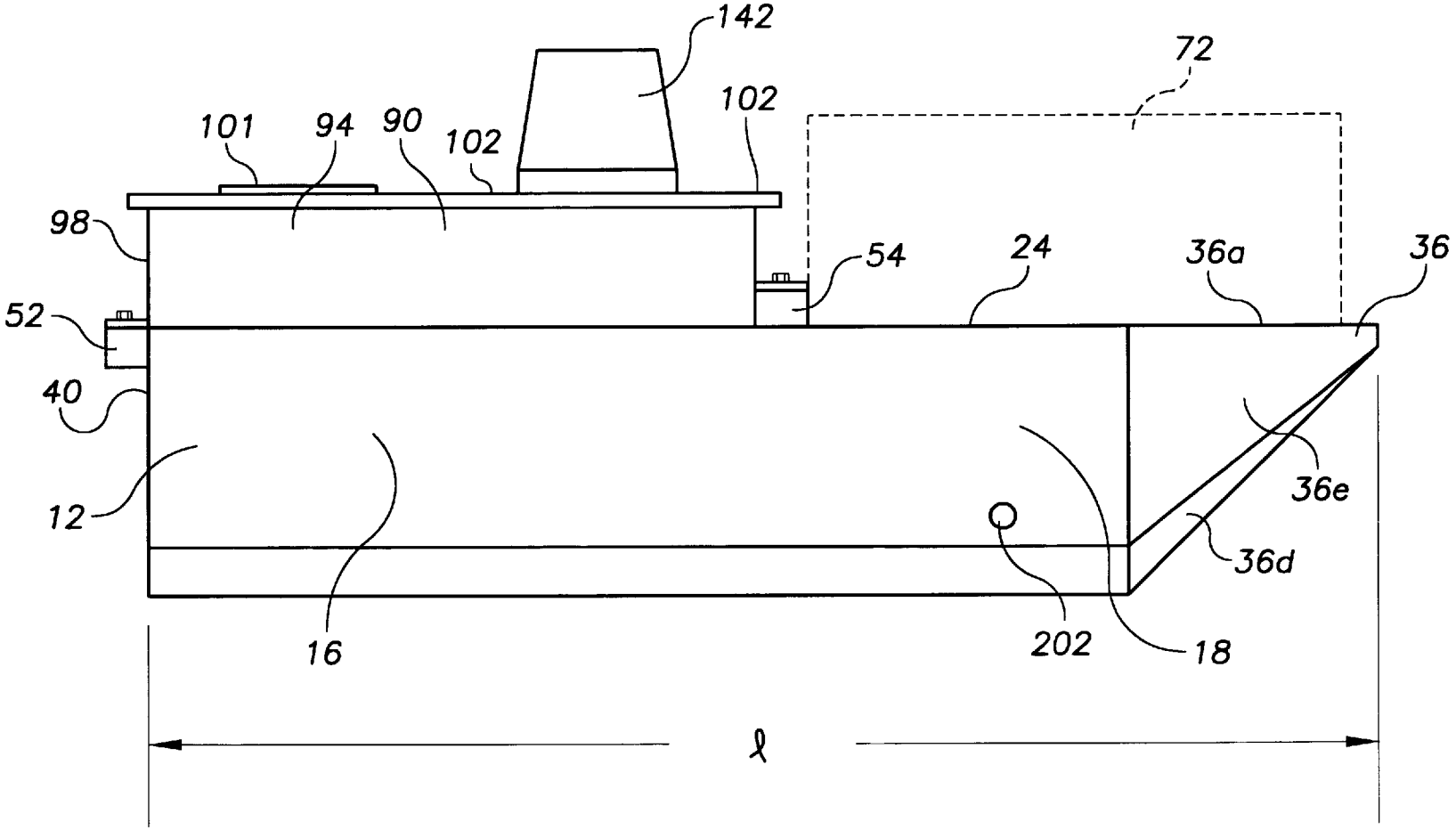
FIG. 3 left side view of the vessel of the present invention.

Referring to the drawings, particularly FIGS. 1–3, there is shown the vessel 10 of the present invention. Vessel 10 is a miniature, pontoon boat. As used herein, miniature is intended to mean smaller than a full size boat. The preferred dimensions of vessel 10 are 48 inches or 121.90 cm in length, represented by letter "l" in FIG. 3, 36 inches or 91.44 cm in width, represented by the letter "w" in FIG. 1 and FIG. 2, and 22.5 inches or 57.15 cm in height, represented by the letter "h" in FIG. 1 and FIG. 2. Suitable ranges for these dimensions are as follows: from 42 inches (106.7 cm) to 54 inches (137.2 cm) for 1, from 30 inches (76.2 cm) to 42 inches (106.7 cm) for w, from 16.5 inches (41.91 cm) to 28.5 inches (72.39 cm) for h.

Vessel 10 is not intended to carry passengers. As stated above, one of the advantages of the present invention is that vessel 10 allows the transportation and operation of data collection apparatus without the need to-have operators of the apparatus on board vessel 10. With the present invention, measuring and sampling in aquatic environments, stream flow and velocity, water quality, bathymetry and the surveying of locations can be performed in a remotely controlled fashion. For purposes of this description, "front" will be used to signify bow, "rear" signifies stern, "right" signifies starboard, and "left" signifies port.

The data collection apparatus is intended to mean a device or combination of devices which can be used to gather information. With the present invention, such apparatus is mounted upwardly and forwardly on vessel 10, as will be described hereinbelow. The movement or travel of vessel 10 on water can be controlled remotely, as well as the deployment or operation of the data collection apparatus thereon.

For example, the data collection apparatus may be low weight Doppler which, through the change of frequency of sound or light waves, permits the collection of distances or shapes of the water body vessel 10 is travelling on, as well as the possible identification of under water structures, such as sunken vehicles. As used herein, low weight is intended to mean about 30 lbs (13.61 kg) or less. The data collection apparatus may also be devices to obtain and store samples of water for further analysis. The apparatus may also be photographic imaging equipment for taking photographs above or below the water. Accordingly, the present invention is useful for remotely deploying a great variety of devices for collection of water data and it is able to accomplish the investigative efforts which previously required a crew of technicians using a conventional full size boat.

Vessel 10 is preferably constructed completely of non-magnetic metal, most preferably aluminum which is light in weight. As used herein, non-magnetic is intended to mean unable to physically attract like materials. Given that the water bodies upon which vessel 10 may be used can contain metallic pollutants, it is desirable that vessel 10 not attract such objects to its structure. Vessel 10 weighs about 100 pounds (45.36 kg) when fully assembled. The miniature size and light weight of vessel 10 make it inexpensive to construct, easy to carry and stable when in use. Vessel 10 is light enough for two people to carry it to remote areas where it would be difficult or impossible to transport a full size boat on land utilizing a trailer. Vessel 10 may be easily loaded onto the bed of a regular size pick-up truck. The vessel's dimensions, particularly, height, h, minimize wind resistance when vessel 10 is in use on a body of water. Its width, w, and length, l, make it suitable for entering narrow or constricted spaces when in use.

Vessel 10 has first pontoon 12 and second pontoon 14 spaced opposite and parallel to each other. As used herein, pontoon is intended to mean a generally rectangular, hollow member able to float on water. Vessel 10 is not intended to be submerged entirely in water. It is not intended for use under water as a submarine. When in use, the pontoons will be only partially submerged in water and are able to float thereon. More specifically, when vessel 10 is in use, the water line should preferably reach about twenty to thirty percent (20 to 30%) of height, h from the bottom of the pontoons. This permits vessel 10 to minimize water resistance or drag in aquatic environments that are highly viscous, such as areas having mud or muck therein. Additionally, in such manner the water data collection apparatus being transported by vessel 10 is kept away from the interference of turbulent water or breaking waves.

Each pontoon has a rear section and a front section. The rear section spans the rear half of the pontoon and the front section spans the front half of the pontoon. Accordingly, each such section is about 24 inches or 60.96 cm. The rear section of first pontoon 12 is represented by reference number 16 and the front section of first pontoon 12 is represented by reference number 18 in FIG. 3. The rear section of second pontoon 14 is represented by reference number 20 and the front section of second pontoon 14 is represented by reference number 22. First pontoon 12 has top side 24 and bottom sides, 26 and 28. Second pontoon 14 has top side 30 and bottom sides 32 and 34. The said top sides are flat or completely planar. When in use, the top sides of the pontoons will be visible to viewers on shore and the bottom sides will be in contact with the body of water upon which vessel 10 is intended to travel. First pontoon 12 has inner side 46 facing second pontoon 14 and outer side 44 opposite inner side 46 facing the aquatic environment. Second pontoon 14 has inner side 50 facing first pontoon 12 and outer side 48 opposite inner side 50 facing the aquatic environment.

As depicted in FIG. 2, angle (a) between first bottom side 32 of second pontoon 14 and second bottom side 34 of second pontoon 14 and angle (b) between first bottom side 26 of first pontoon 12 and second bottom side 28 of first pontoon 12 are preferably each between 156 degrees and 166 degrees, and most preferably 161 degrees. These angular dimensions optimize the travel or movement of vessel 10 on water. Additionally, as will become apparent from the description hereinbelow, the noted angular dimensions maximize the entry of water into the pontoon bow thrusters which provide propulsion and direction control to vessel 10.

Pontoon front sections, 18 and 22, each terminate in a five sided tip. Referring to FIG. 1 and FIG. 3, first pontoon tip 36 has sides, 36*a*, 36*b*, 36*c*, 36*d* and 36*e*, designated in a clockwise fashion in the front view of FIG. 1. Side 36*a* corresponds to first pontoon top side 24 and is contiguous therewith. Second pontoon tip 38 has sides, 38*a*, 38*b*, 38*c*, 38*d* and 38*e*. Side 38*a* corresponds to second pontoon top side 30 and is contiguous therewith. The pontoon tips assist vessel 10 in moving through aquatic environments, particularly those which may be populated by vegetation, mud, muck or waste pollutants. Pontoon tips 36 and 38 can pierce or cut through such potential obstacles to ultimately arrive at the intended destination. The pontoon ends directly opposite tips 36 and 38 terminate in flat panels, 40 and 42 shown in the back view of FIG. 2. First pontoon rear section 16 terminates in flat panel 40 and second pontoon rear section 20 terminates in flat panel 42.

Figure 4:
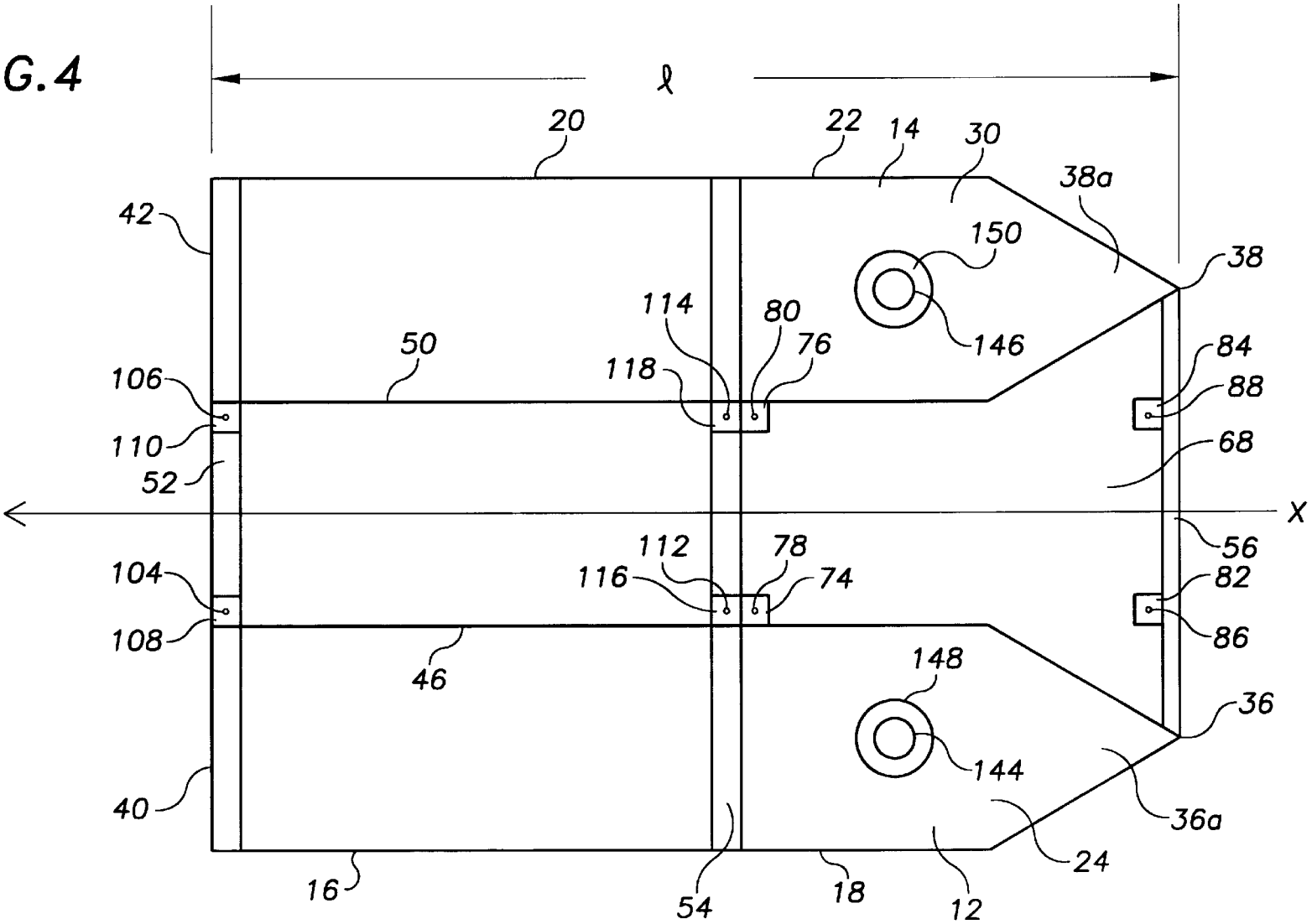
FIG. 4 is a top plan view of the vessel of the present invention without the electro-mechanical module.
Figure 5:
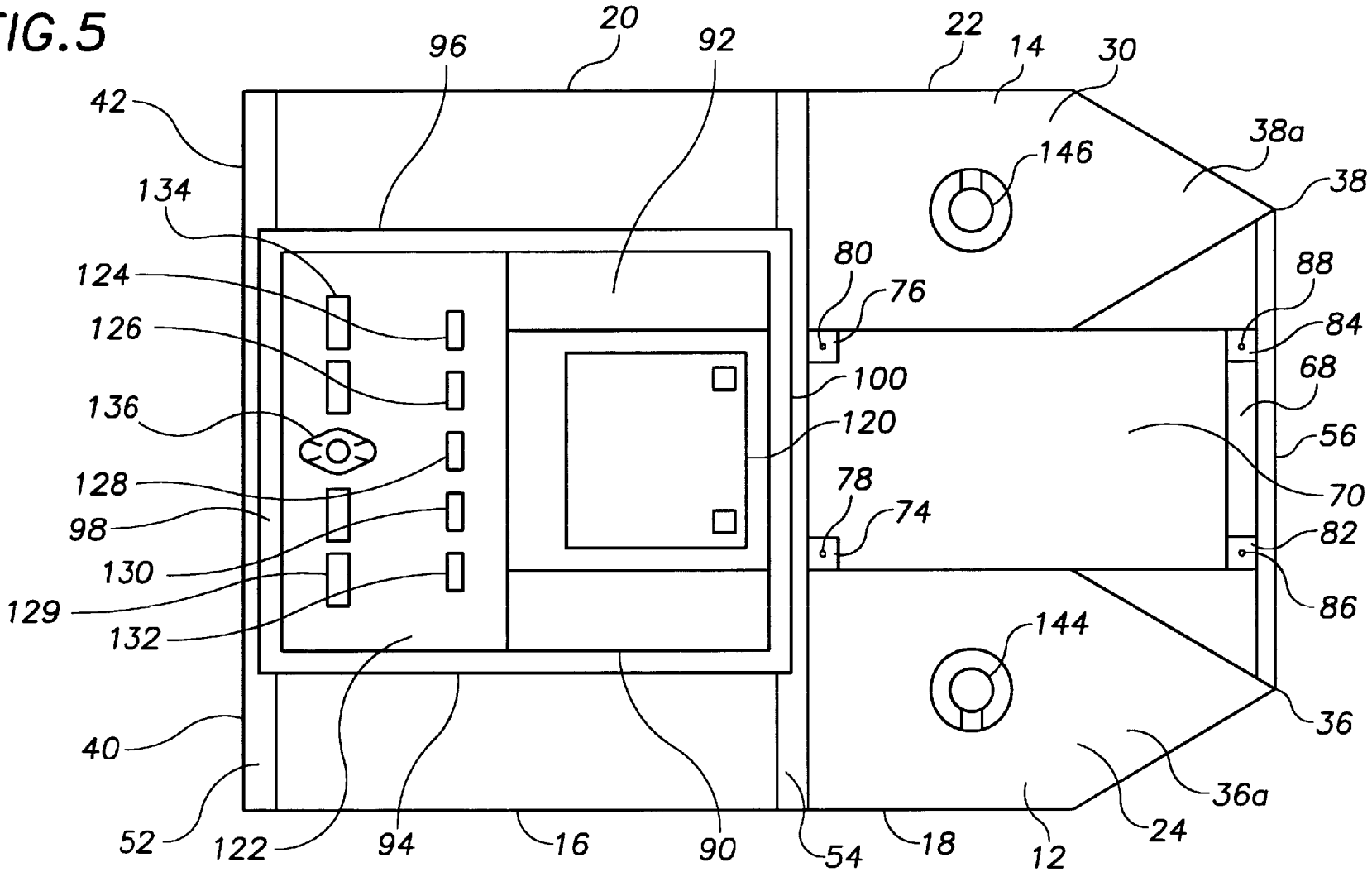
FIG. 5 is a top plan view of the vessel of the present invention showing the interior of the electro-mechanical module.

As stated above, vessel 10 including pontoons 12 and 14 are made of non-magnetic metal, preferably aluminum. First pontoon 12 and second pontoon 14 are permanently secured opposite and parallel to each other by at least one transverse member horizontally spanning the pontoons. Referring to FIG. 4 and FIG. 5, pontoons 12 and 14 are welded together in the arrangement shown therein through the use of first transverse member 52, second transverse member 54 and third transverse member 56, which are hollow aluminum rods that may be rectangular or cylindrical in shape. First transverse member 52 is welded to first pontoon rear section 16 and second pontoon rear section 20. Second transverse member 54 is welded to first pontoon front section 18 and second pontoon front section 22. Third transverse member 56 spans first pontoon tip 36 and second pontoon tip 38, and is welded thereto. As used herein, welding is intended to mean heating until molten and fused together.

The first transverse member, second transverse member and third transverse member are parallel to each other. As described, the pontoons are held permanently opposite and parallel to each other by three transverse members. However, only one transverse member, namely second transverse member 54, is essential to structure retention. Hence vessel 10 should have at least one transverse member to hold the pontoons apart and parallel.

Propulsion of vessel 10 is provided by a propulsion means 59 located between first pontoon rear section 16 and second pontoon rear section 20. Propulsion means includes drive motor 60 and a rudder/propeller represented in combination by reference number 96. The preferred propulsion means is model 361743 trolling motor manufactured by Motor Guide. However, various other motor driven propeller systems may be used so long as the length, width and height dimensions of same do not exceed 12 inches (30.48 cm) and the weight of same does not exceed 20 pounds (9.072 kg). Propulsion means 59 is operatively connected to electro-mechanical module 90. As used herein, operatively connected is intended to mean attached mechanically and electrically to permit operation of the propulsion means. Additional propulsion for vessel 10 is provided by the bow thrusters contained within the pontoons, which will also be described in greater detail hereinbelow.

Referring to FIGS. 3–5, the area represented by reference number 68 between first pontoon front section 18 and second pontoon front section 22 is an open area for receiving and holding data collection apparatus, such as low-weight, acoustic Doppler devices. Open front area 68 receives front platform 70, which is an optional, removable aluminum plate that can serve as a base or support for the data collection apparatus 72, which is represented in phantom (dotted lines) in FIG. 3, whenever the particular apparatus requires a base or support. The data collection apparatus is mounted upwardly from the pontoons and forwardly from the electro-mechanical module 90. Front platform 70 is mounted above the pontoon top sides 24 and 30, and is not intended to be in contact with the water body. Second transverse member 54 has first mounting tab 74 and second mounting tab 76 for removably securing front platform 70 by receiving and removably retaining front platform first screw 78 and front platform second screw 80, respectively. Third transverse member 56 has third mounting tab 82 and fourth mounting tab 84 for removably securing front platform 70 by receiving and removably retaining front platform third screw 86 and front platform fourth screw 88, respectively. The mounting tabs are preferably made of aluminum and affixed to the transverse members by welding.

Open front area 68 permits apparatus 72 to have unobstructed access to the body of water which is to be researched or surveyed through the use of vessel 10. Open front area 68 is large enough to receive and hold data collection apparatus 72 and still leave sufficient open space in front of apparatus 72 and below apparatus 72 to permit the apparatus to have access to the water below and the area directly in front of vessel 10. This is of particular importance, where the apparatus must obtain data or samples from the area directly below vessel 10 or directly in front of vessel 10. Even though unobstructed access is permitted, the twin pontoons provide protection to apparatus 72 by absorbing the force of occurrences such as unintentional collisions with objects in the water or on overgrown banks.

Electro-mechanical module 90 contains all the electronic components required to operate vessel 10, including the power source and servo tray. With reference to FIG. 5, module 90 has a floor 92 and four walls (left wall 94, right wall 96, back wall 98, and front wall 100) covered by roof 102. The floor, walls and roof are aluminum plates. The floor, walls and roof form a water tight compartment for enclosing the electronic components. As used herein, watertight is intended to mean constructed so as to be impermeable to water. Impermeable construction is accomplished by welding the aluminum plates to each other (92, 94, 96, 98 and 100) into the form of a box sealed with a neoprene rubber gasket 101 on the roof. The placement of electro-mechanical module 90 between first pontoon inner side 46 and second pontoon inner side 50 midway or halfway along each said inner side provides protection for module 90 by the pontoon structures which partially cover or bind the left and right walls of the module. The placement of electro-mechanical module 90 in the rear of vessel 10 avoids any interference or obstruction by the electro-mechanical components to apparatus 72 which is mountable in open front area 68. Moreover, electro-mechanical module 90 provides the center of gravity at the rear of vessel 10. The weight of electro-mechanical module 90 is intended to be 150 to 200% greater than the weight of apparatus 72. As such, the position of front platform 70 and apparatus 72 when mounted is higher or raised in comparison to the position of the electro-mechanical module. This weight distribution allows proper positioning of pontoon front sections 18 and 22 with respect to pontoon rear sections 16 and 20. Accordingly, apparatus 72 can be maintained at appropriate distances with respect to the water line when vessel 10 is in use in an aquatic environments.

Electro-mechanical module 90 may be removed from vessel 10, such as for repairs. Module 90 is removably secured to vessel 10. With reference to FIG. 4 and FIG. 5, module back wall 98 is attached to first transverse member 52 by back wall left screw 104 and back wall right screw 106 which respectively fit first transverse member left mounting tab 108 and first transverse member right mounting tab 110. Module front wall 100 is attached to second transverse member 54 by front wall left screw 112 and front wall right screw 114 which respectively fit second transverse member left mounting tab 116 and second transverse member right mounting tab 118. The mounting tabs are preferably made of aluminum and affixed to the electro-mechanical module 90 by welding. Module 90 can be easily removed for repairs by unthreading the noted screws and is a water tight compartment which protects all of the electronic components contained within. Module 90 also serves to provide buoyancy. In case one or both of the pontoons sustain damage or are disabled during use, module 90 can independently float on water.

Vessel 10 has power source 120 contained within electro-mechanical module 90 to provide electric energy for running the electronic components of the present invention. Power source 120 is preferably a 50 pound (22.68 kg), 12 Volt, 40 ampere/hour gel-cell re-chargeable battery that powers vessel 10. The power source is converted to 5 Volts to permit operation of the radio receiver and the servos. It is intended that power source 120 permit the operation of vessel 10 for at least 3 continuous hours. For purposes of this description, FIG. 5 shows the interior of module 90 without its roof, including the layout of servo tray 122. The servo tray is a generally rectangular aluminum receptacle with slightly raised edges having a plurality of openings therein of a size and shape for retaining servos. With reference to FIG. 5 and schematic FIG. 8, servo tray 122 which is also contained within module 90 holds all of the servos, including high thrust servo 124, strobe light servo 126, reverse servo 128, digital speed control 129, first bow thruster servo 130, second bow thruster servo 132, rudder servo set 134 and servo arm 136. As used herein, servo is intended to mean a mechanical device able to move in angular rotation such that its mechanism controls the movement of another independent one. Module 90 houses all the servos that permit steering and control of the mechanical functions of vessel 10. The preferred servos used in vessel 10 are S3801 and S148 manufactured by Futuba.

High thrust servo 124 is operatively connected to drive motor 60 to permit its running at high thrust, which is considered to be 22 pounds (9.979 kg) of thrust. Strobe light servo 126 is operatively connected to strobe light 142 mounted on roof 102 so as to permit its activation by hand held radio control to warn oncoming boat traffic of the presence of vessel 10. Strobe light 142 also serves as a low battery indicator, which turns on automatically when the power in battery 120 is at 25%. This allows sufficient time for the operators of vessel 10 to finish measurements and bring vessel 10 back to shore. Digital speed control 129 takes a modulated signal from the remote control receiver and converts it to an amount of power delivered to drive motor 60 to which it is operatively connected. Reverse servo 128 is operatively connected to drive motor 60 to permit its running in reverse. Servo arm 136 is operatively connected to drive shaft 66 so at to permit its regulation and control. Rudder servo set 134 is operatively connected to rudder/propeller 96 to control its direction and motion. The drive motor 60 is controlled by an infinitely variable power source enabling vessel 10 to have variable thrust from zero to twenty-two pounds (9.979 kg). This thrust is able to move vessel 10 at 4 feet/second (1.219 meters/second ) or 2.73 Miles Per Hour (4.394 km/hour). The bow thruster servos 130 and 132 are operatively connected to the bow thrusters, which are described hereinbelow, to permit their control.

Figures 1, 8:
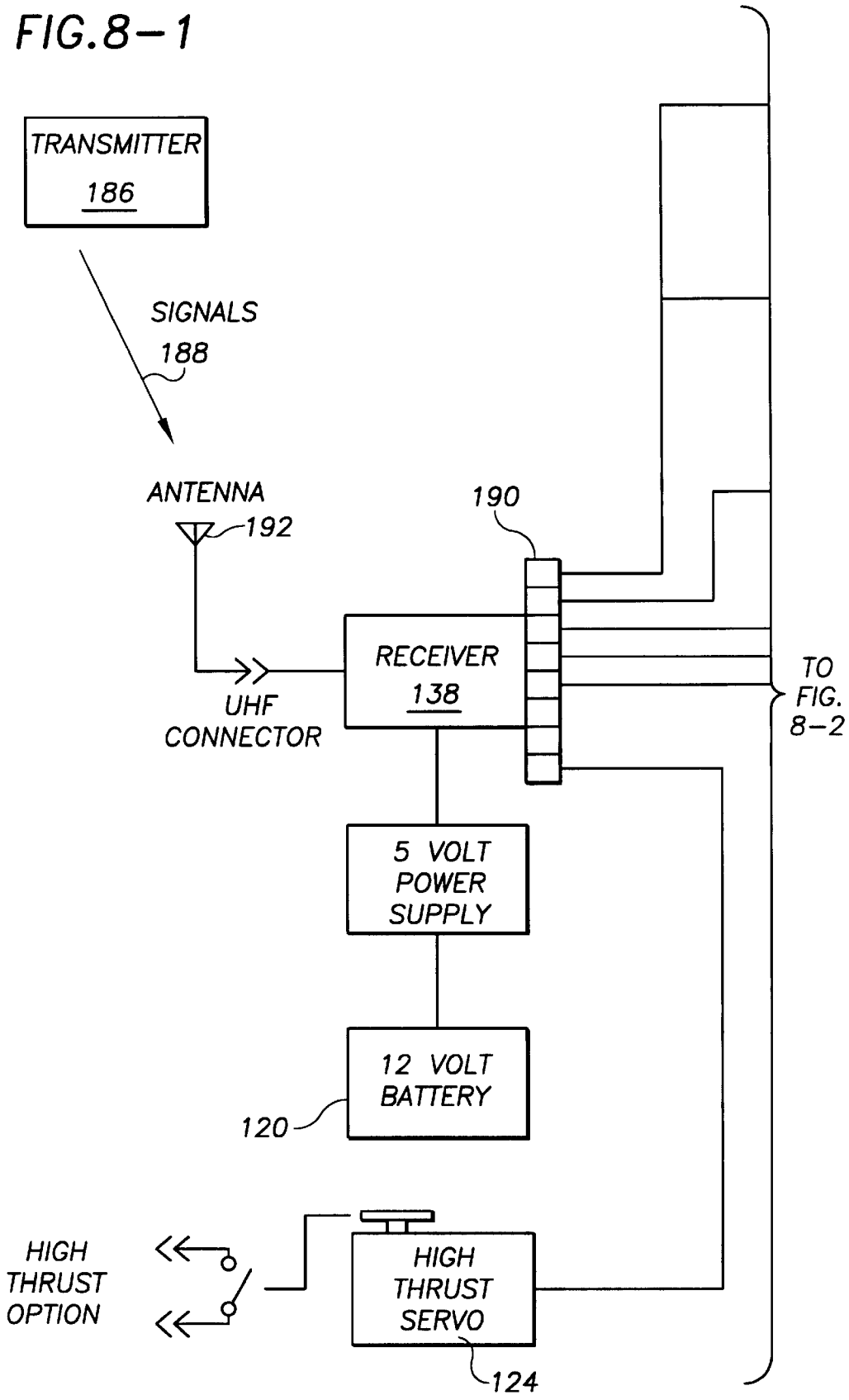
FIG. 8 is a schematic diagram depicting remote control of the vessel of the present invention.
Figures 2, 8:
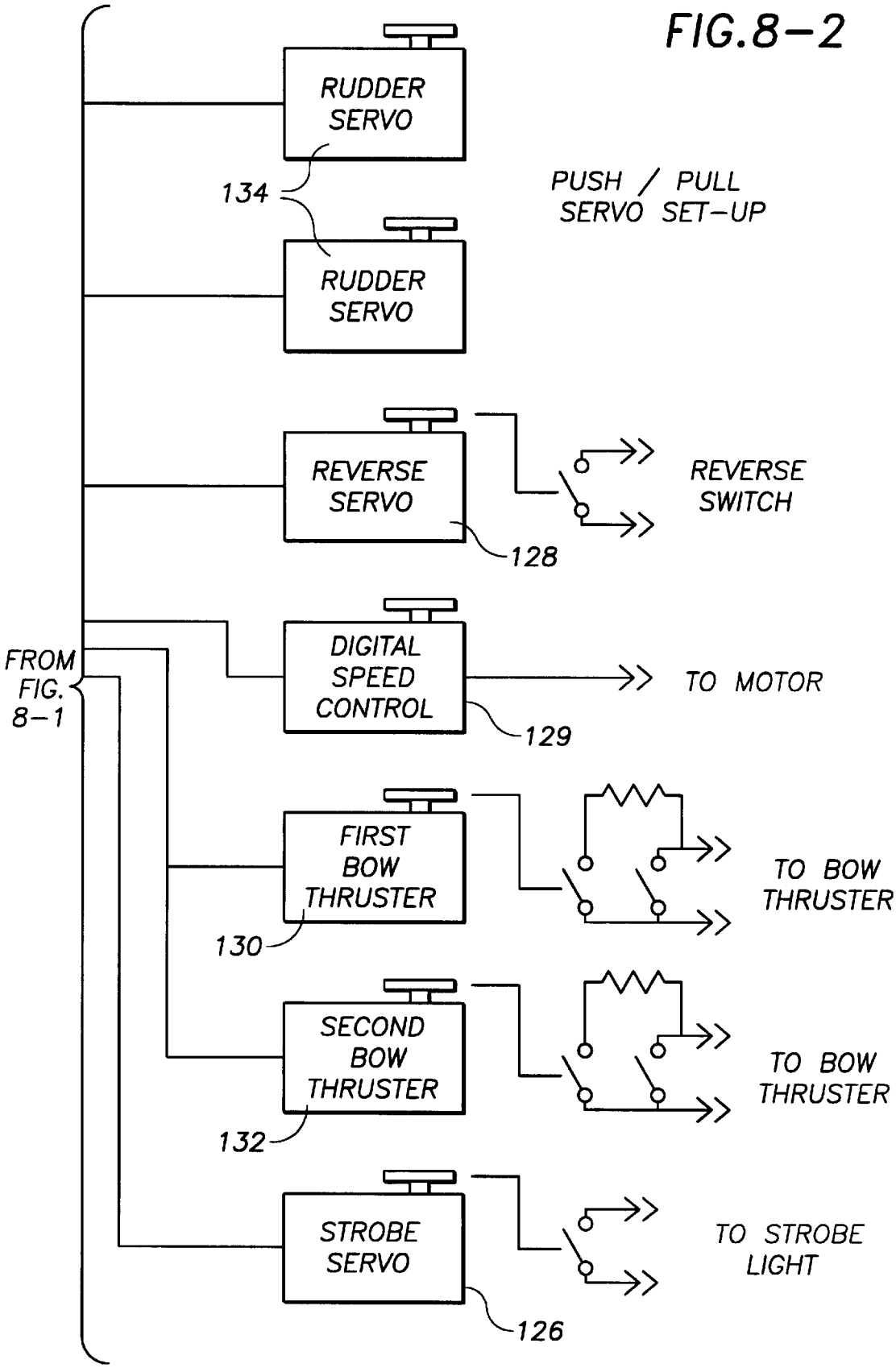

Module 90 also holds radio receiver 138 and modem 140 which are located below servo tray 122 as shown in the cross-section view of FIG. 6. All vessel functions are controlled from shore through the use of a hand held model airplane 75 Mhz radio control of up to eight channels. Radio control systems for boats, airplanes and the like are well known and will not be discussed in detail herein. Such radio control systems are commercially available from manufacturers such as Futuba, Hitec, JR and the like. Basically, as shown in FIG. 8, a radio transmitter 186 on shore generates control signals 188 on predetermined frequencies. A frequency channel is provided for each function to be regulated. A first transmission channel is provided for regulating the rudder, a second channel is provided for regulating the reverse servo, a third transmission channel is provided for regulating the digital speed control, a fourth transmission channel is provided for regulating the first bow thruster servo and the second bow thruster servo, a fifth transmission channel is provided for regulating the strobe light servo, a sixth transmission channel is provided for regulating the high thrust servo, and so on. The use of radio control systems is stated herein for vessel 10. However, remote control systems other than radio control may be used. Control signals 188 are received by radio receiver 138 through antenna 192 located on vessel 10. The receiver demodulates the control signals 188 and passes the demodulated signals to control means 190 which provides power, speed and direction control information to the servos that, as stated above, in turn regulate the components which they are operatively connected to.

Additional propulsion for vessel 10 is provided by first bow thruster 144 and second bow thruster 146. First bow thruster 144 is housed or contained within first pontoon front section 18 and second bow thruster 146 is housed or contained within second pontoon front section 22 as shown in the cross section view provided in FIG. 6. Bow thrusters 144 and 146 allow vessel 10 to spin or turn on its center axis (x), shown in FIG. 4, without moving its position forward or backward, thereby permitting easy positioning of vessel 10, especially in narrow or constricted spaces. This gives vessel 10 the unique ability to follow a straight course through the body of water, and turn about on its axis and repeat the same course on the way back. This ability is very desirable when measuring stream flow discharges because repeatability of the same straight line to uniquely describe a specific stream or channel cross section is essential to the data collection procedure.

Figure 6:
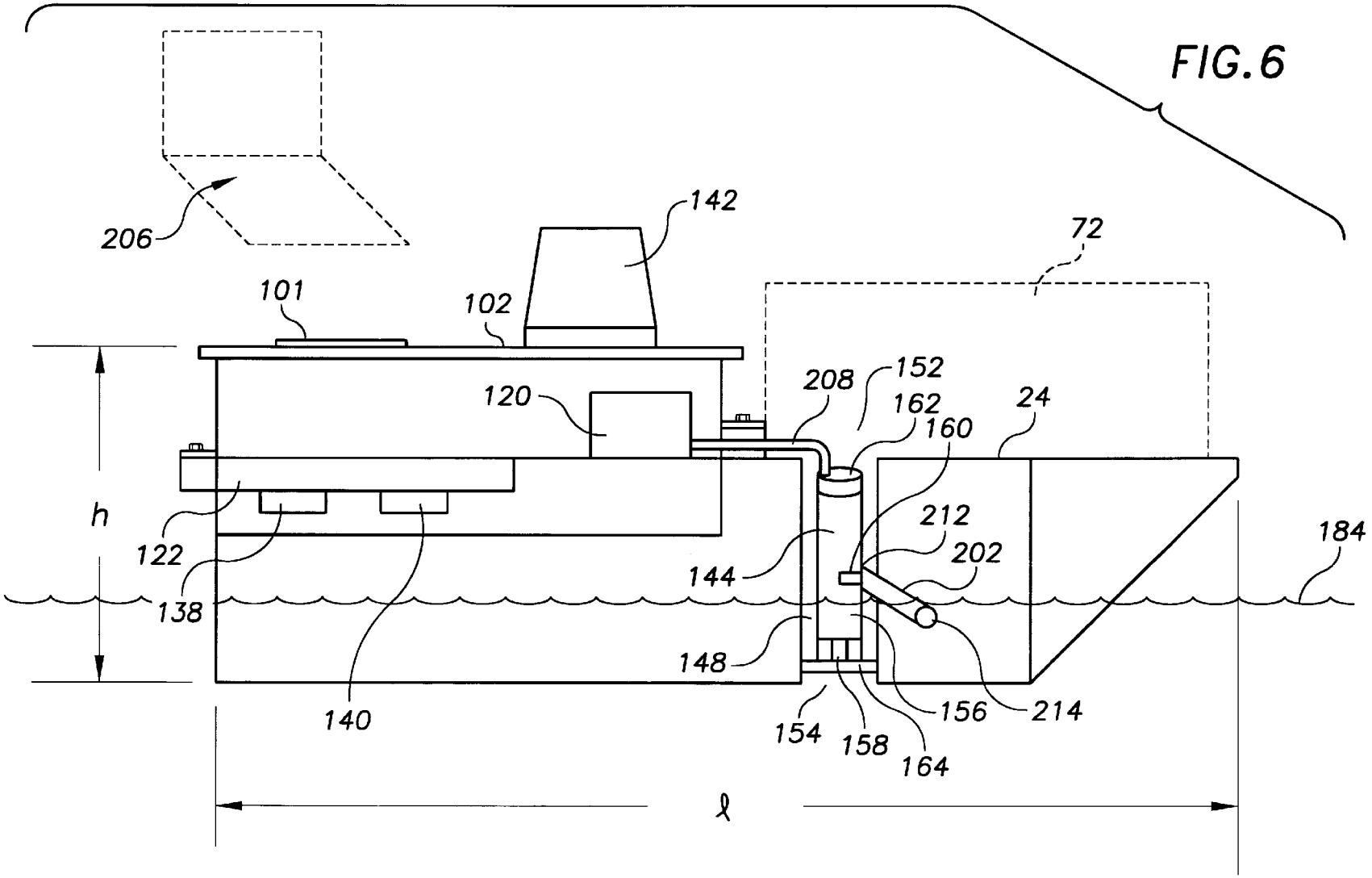
FIG. 6 is a cross section view of the vessel of the present invention.
Figure 7:
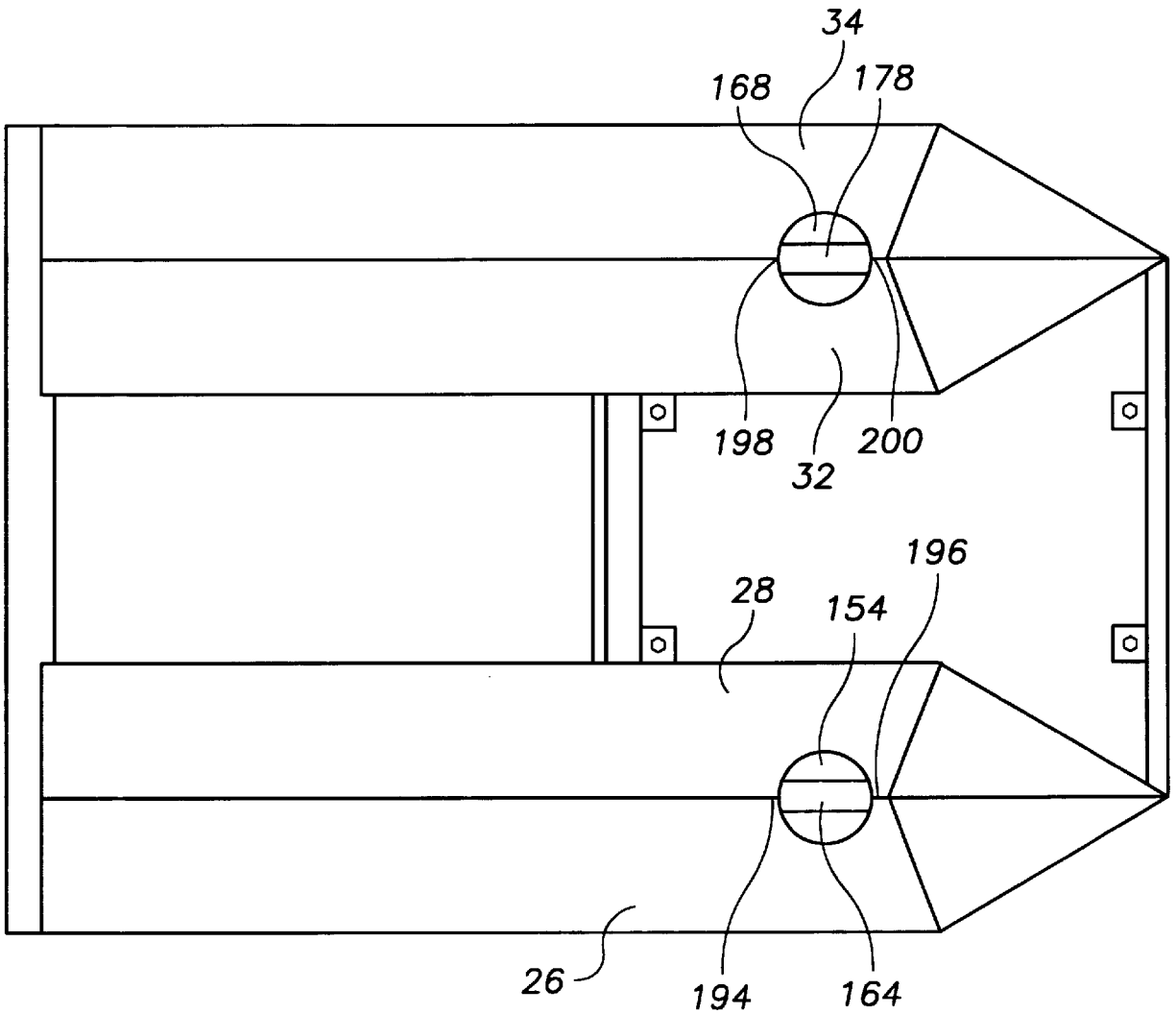
FIG. 7 is a view of the bottom of the vessel of the present invention.

Referring to FIG. 6 and FIG. 7, each pontoon has a vertical channel 148 and 150, respectively, running vertically within the pontoon. Channel 148 of first pontoon 12 is shown in cross section in FIG. 6. FIG. 6 shows a cross-section of the left side of vessel 10 including first pontoon 12. However, it is intended that second pontoon 14 have the same components and cross-section although not separately depicted to avoid duplicative drawings. Each channel is cylindrical in shape. Vertical channel 148 has top channel aperture 152 on top side 24 of first pontoon 12, and bottom channel aperture 154 between first bottom side 26 and second bottom side 28 of first pontoon 12. Mounted and housed within vertical channel 148 is bow thruster 144 which includes water pump 156, having a pump impeller 158 and a water discharge means 160, and motor 162, powered by power source 120 through electrical connection 208. Bow thruster 144 is maintained within channel 148 by retention strap 164 which spans bottom channel aperture 154 and is held in place by welding at weld points 194 and 196 to the pontoon. Vertical channel 150 of second pontoon 14 has top channel aperture 166 on top side 30 of second pontoon 14 and bottom channel aperture 168 between first bottom side 32 and second bottom side 34 of second pontoon 14. Mounted within channel 150 is bow thruster 146 which includes water pump 170 having pump impeller 172, water discharge means 174 and motor 176, powered by power source 120 through electrical connection 210. Bow thruster 146 is maintained within channel 150 by aluminum retention strap 178 which spans bottom channel aperture 168 and is held in place by welding at points 198 and 200. The water discharge means is preferably an aluminum cylindrical tube having an inner or inside diameter of 1.25 inches (31.75 mm). Channel apertures 152, 154, 166 and 168 are circular having a diameter of 4 inches (10.16 cm).

As stated above, FIG. 6 shows a cross-section of the left side of vessel 10. Given that the right side view is identical, it is not separately depicted in the drawings. The first pontoon bow thruster and the second pontoon bow thruster have the same components, which are numbered separately for purposes of this description. Water pumps 156 and 170 are preferably 1100 gallon-per-hour GPH (4164 liters per hour) water pumps having impellers which are means or devices suitable for impelling or drawing in water. Water is drawn through bottom channel apertures 154 and 168 respectively by pump impellers 158 and 172 into pumps 156 and 170 and discharged forcibly through discharge means 160 and 174, which are respectively connected by welding to first pontoon horizontal exhaust 202 and second pontoon horizontal exhaust 204, that lie below the vessel's water line. Exhausts 202 and 204 are horizontal pontoon openings that intersect the vertical channels 148 and 150 in a perpendicular fashion. Horizontal exhaust 202 of first pontoon 12 has a distal end 212 and a proximal end 214. The distal end 212 intersects perpendicular to the vertical channel 148 and is connected by welding to discharge means 160. Proximal end 214 terminates at the pontoon outer side 44. Horizontal exhaust 204 of second pontoon 14 has distal end 216 and proximal end 218. Distal end 216 intersects perpendicular to vertical channel 150 and is connected by welding to discharge means 174. Proximal end 218 terminates at pontoon outer side 48. The horizontal exhausts are also cylindrical in shape. Proximal ends 214 and 218 are located at the bottom edge of the pontoon outer sides 44 and 48. When vessel 10 is in use on a body of water, proximal ends 214 and 218 are below the water line represented in FIG. 6 by reference number 184.

The forcible discharge of water through exhausts 202 and 204 below the water line provides the necessary thrust for vessel 10 to turn about its vertical axis, represented by the letter x in FIG. 4, a motion referred to as yawing. As described, the bow thrusters yaw vessel 10 with data collection apparatus 72 mounted thereon in a radial motion from port to starboard and vice versa. As such, bow thrusters 144 and 146 allow vessel 10 to maintain a desired course and provide the maneuverability necessary for scientific measurements such as those which must be repeated along liner paths, as well as maneuverability in narrow or constricted areas along banks. The configuration of the pontoons of the present invention facilitates the intake of water into the bow thrusters. As stated above, angle (a) and angle (b) are obtuse angles permitting easy and secure placement of the bow thrusters within the vertical channels. It should also be noted, as shown in FIG. 7, bottom aperture 154 is centered or located central to the intersection of first pontoon bottom sides 26 and 28, just as bottom aperture 168 is centered or located central to the intersection of second pontoon bottom sides 32 and 34. Accordingly, the described central placement of the vertical channels and their respective bottom apertures maximizes the intake of water into the bow thrusters contained within.

With the present invention, real time data collection is possible. As shown in FIG. 6, modem 140 provides bi-directional real time data transfer from the onboard data collection apparatus 72 to a laptop computer 206 on shore having specialized data collection software. Modem 140 is preferably a wireless RS-232 modem that can convert data from digital computer signals to analog signals and vice-versa. RS-232 refers to the recommended standard for serial communications adopted by the Electrical Industries Association. The preferred modem is FreeWave model DGR-115W. As used herein, real time operations are those in which the activities of apparatus 72 match the user's perception of time or those in which the operations of computer 206 proceed at the same rate as a physical or external process. Accordingly, with the present invention the user has the ability to change parameters and adjust apparatus 72 to the conditions of the stream or relevant water body. For example, the mode operations of apparatus 72 and all the direct control commands related thereto can be changed through use of the modem, such as when apparatus 72, is Doppler. Configuration and other files can also be modified and transferred through the modem connection.

From the foregoing description, it will be appreciated the vessel of the present invention provides numerous advantages and benefits, including that it is easily portable, remotely controllable and able to provide real time data collection. The vessel provides a suitable, protective platform for sensitive data collection apparatus. It also permits access to remote or constricted areas not previously accessible.

While the invention has been described in detail for the preferred form shown, it will be understood that modifications may be made without departing from the spirit and scope of the invention and the appended claims.

What is claimed is:

1. A vessel for collection of water data in aquatic environments, comprising:

(a) a first pontoon having a rear section and front section;

(b) a second pontoon having a rear section and front section, each said pontoon having a flat top side, an outer side, an inner side, a two sided bottom, wherein said front section of each said pontoon terminates in a five sided tip and the rear section of each said pontoon terminates in a flat panel, and wherein each said pontoon front section has a vertical channel from said flat top side to said two sided bottom and a horizontal exhaust having a distal end and a proximal end, said distal end intersecting perpendicular to said vertical channel and said proximal end terminating at said pontoon outer side; and (c) an open area between the front section of the first pontoon and the front section of the second pontoon, said open area being of a size and shape suitable for receiving a data collection apparatus platform, wherein said vessel has at least one transverse member for permanently holding said first pontoon and said second pontoon opposite and parallel to each other.

2. The vessel of claim 1 further comprising a bow thruster housed within each said vertical channel.

3. The vessel of claim 2 wherein each said bow thruster comprises a water pump capable of drawing water through said vertical channel at the two sided bottom and forcibly expelling said water through said horizontal exhaust distal end.

4. The vessel of claim 1 further including an electro-mechanical module between said rear section of the first pontoon and the rear section of the second pontoon.

5. The vessel of claim 4 wherein said electro-mechanical module comprises a power source, a remote control receiver, a propulsion means, a plurality of servos operatively connected to permit remote control of the vessel.

6. The vessel of claim 5 wherein the electro-mechanical module further includes a modem capable of real time communication of data.

7. A vessel for collection of water data in aquatic environments, comprising:

(a) a first pontoon having a rear and front section, said front section terminating in a five sided tip;

(b) a second pontoon having a rear and front section, said front section terminating in a five sided tip, wherein said first pontoon and said second pontoon are held opposite and parallel to each other by at least one transverse member, wherein each said pontoon has a flat top side, a two sided bottom, an inner side, an outer side, a vertical channel between said top side and said bottom, said channel being of a size and shape suitable for housing a bow thruster, and (c) a removable front platform between said first pontoon front section and said second pontoon front section, said platform being capable of supporting data collection apparatus.

8. The vessel of claim 7 further comprising a horizontal exhaust, having a distal end perpendicular to said vertical channel and a proximal end terminating at the pontoon outer side.

9. The vessel of claim 8 further including a bow thruster within said vertical channel, said bow thruster comprising a motor driven water pump for drawing water through said channel at the pontoon bottom and a water discharge means connected to said horizontal exhaust for forcibly expelling water there through.

10. The vessel of claim 7 further including an electro-mechanical module between said rear section of the first pontoon and the rear section of the second pontoon.

11. The vessel of claim 10 wherein said electro-mechanical module comprises a power source, a remote control receiver, a propulsion means, a plurality of servos operatively connected to permit remote control of the vessel.

12. The vessel of claim 11 wherein the electro-mechanical module further includes a modem capable of real time communication of data.

13. A vessel for collection of water data in aquatic environments, comprising a first and second opposite spaced pontoon, each said pontoon having a rear section, a front section, a top, a bottom, an outer side and an inner side, wherein each pontoon has a bow thruster capable of drawing in water from the pontoon bottom and forcibly discharging water at the pontoon outer side, said vessel further including an electro-mechanical module between said rear section of the first pontoon and the rear section of the second pontoon wherein said electro-mechanical module comprises a power source, a remote control receiver, a propulsion means, a plurality of servos operatively connected to permit remote control of the vessel and a modem capable of real time communication of data.

14. The vessel of claim 13 further including an electro-mechanical module between said rear section of the first pontoon and the rear section of the second pontoon.

15. The vessel of claim 14 wherein said electro-mechanical module comprises a power source, a remote control receiver, a propulsion means, a plurality of servos operatively connected to permit remote control of the vessel.

* * * * *